US005146816A

United States Patent [19]

Badstieber

[11] Patent Number: 5,146,816

[45] Date of Patent: Sep. 15, 1992

[54] CONNECTING FORMWORK PANELS

[75] Inventor: Johann Badstieber, Rutesheim, Fed. Rep. of Germany

[73] Assignee: Josef Maier, Steinach, Fed. Rep. of Germany

[21] Appl. No.: 679,039

[22] PCT Filed: Oct. 18, 1989

[86] PCT No.: PCT/DE89/00658

§ 371 Date: May 13, 1991

§ 102(e) Date: May 13, 1991

[87] PCT Pub. No.: WO90/05225

PCT Pub. Date: May 17, 1990

[30] Foreign Application Priority Data

Nov. 12, 1988 [DE] Fed. Rep. of Germany ..... 8814208

[51] Int. Cl.[5] ..... B25H 3/00

[52] U.S. Cl. ..... 81/487; 269/218; 269/236

[58] Field of Search ..... 81/487; 269/218, 235, 269/236, 249

[56] References Cited

U.S. PATENT DOCUMENTS

| | | | |
|---|---|---|---|
| 919,971 | 4/1909 | Smith | 269/218 |
| 1,709,385 | 4/1929 | Young | 269/218 |
| 2,325,417 | 7/1943 | Merrill et al. | 269/236 |
| 2,560,929 | 7/1951 | Calbeck | 269/236 |

OTHER PUBLICATIONS

Research Disclosure, Apr. 1985, No. 252 Kenneth Mason Publications Ltd., England.

*Primary Examiner*—Bruce M. Kisliuk
*Assistant Examiner*—Lawrence Cruz
*Attorney, Agent, or Firm*—Peter K. Kontler

[57] ABSTRACT

A clamp for connecting a pair of formwork panels which are to be disposed side-by-side in a common plane has two clamping members. Each of the clamping members includes a clamping arm for urging the panels together and an adjusting arm which is approximately perpendicular to the respective clamping arm. The clamping members are pivotally mounted on a U-shaped support and the adjusting arms are disposed internally of the support with their free ends overlapping. The clamping arms project from the support and are located on the same side of the latter as the transverse web bridging the legs of the support. The legs are provided with registering openings which are elongated transversely of the adjusting arms. A pivot extends through the overlapping ends of the adjusting arms and into the openings. The pivot is guided by the openings for movement transversely of the adjusting arms and carries an eccentric disc which is arranged to bear against the transverse web of the support. An actuating lever for the clamping members is integral with the disc and projects from the support approximately perpendicular to the clamping arms.

22 Claims, 3 Drawing Sheets

CONNECTING FORMWORK PANELS

BACKGROUND OF THE INVENTION

The invention relates to a clamp for connecting formwork panels which are arranged side by side in a plane and have edge profiles, particularly hollow profiles, running round them. The clamp includes two gripping jaws which are adapted to be swivelled against and urge together the oppositely directed longitudinal faces of the abutting edge profiles, and an actuating member for swivelling the gripping jaws. The end each gripping jaw which faces away from the clamping point has an adjusting arm oriented at an angle to the respective jaw. The adjusting arms of the two gripping jaws are directed towards one another and both gripping jaws are swivel-mounted on a bracket approximately in the corner region of the two adjusting arms of the jaws.

Such clamps, for connecting large formwork panels in particular are known in various embodiments. German Patent Specification No. 27 59 966 shows a clamp in which the clamping arms can be drawn towards each other and braced not in a swivelling manner but by a member traversing both the adjusting arms.

A clamp of the kind mentioned at the outset is known from European specification No. 0 201 887, in which the two gripping jaws have a common joint and the two adjusting arms are adapted to be swivelled relative to one another by a bolt traversing them. The joint is disposed in a corner at the transition of a gripping jaw to the adjusting arm thereof. Therefore, when being adjusted, the two gripping jaws are subjected to different lever arms and it is not ensured that there is a uniform transfer of force which can be utilized for aligning the two edge profiles to be connected. It is true that this prior publication also presents a solution with symmetrically disposed clamping jaws each having a swivel joint of its own, However the adjustment is provided for by way of a nut adjustable through a bolt. Apart from the unwanted use of a thread in the region of concrete placement, this also leads to friction and wear at the adjusting arms and additionally to increased expenditure in manufacture during assembly. In addition to this, the use of a thread for adjusting the clamping arms increases the time required to achieve a sufficiently large adjusting path and a clamping force of sufficient magnitude.

SUMMARY OF THE INVENTION

The object underlying the invention is therefore to create a clamp of the kind mentioned at the outset, which is simple in design, enables the formwork panels to be aligned at the same time as they are connected and can be positioned for use and removed again very quickly. It is nevertheless to be possible for the clamping forces, and above all the adjusting movements, to be applied to the two gripping jaws as uniformly as possible, approximately symmetrically to the parting line between the two formwork panels.

This object is accomplished in that the ends of the two adjusting arms overlap and that in the region where the two adjusting arms overlap both are jointly engaged by an eccentric with the pivot or swivel bearing of the latter being slidable perpendicular to the forming surface. If the common eccentric is rotated, the adjusting arms are swivelled and at the same time a corresponding reactive force is applied in the direction of the oblong hole, that is perpendicular to the forming surface.

Therefore, the bracket is simultaneously urged against the outsides of the edge profiles and can align them to one another. It is of advantage that a single rotary motion of the eccentric is sufficient to immediately perform the desired bracing or release motion. This is effected most appropriately by connecting the eccentric, preferably integrally, to an actuating lever. A rotatable spindle with a corresponding pivot bearing and adjustable nut, or similar elaborate machine parts, are avoided in a simple way.

It is of advantage for the desired alignment of the two formwork panels if the bracket for accommodating the adjusting or swivel arms, the joints and the eccentric has a stop face turned towards the profiles to be braced with the stop face running parallel to the forming surface and to the webs of the hollow profiles facing away from the forming surface. It is particularly convenient if this cross member accommodating the bearings or joints of the gripping jaws has a U-shaped cross section. The cross bar of the U is turned towards the edge profiles to be connected and aligned and forms the stopping and aligning face. The U-shape has the advantage that the adjusting arms can be arranged in the interior of this cross member and their swivel joints can be supported by the two legs of the U, that is, the swivel joints can be supported on both sides. In addition, good rigidity and firm strength of this bracket are thereby produced. The bracket performs the triple role of accommodating the swivel bearings for the clamping jaws and adjusting arms, permitting the mounting of the eccentric in an oblong hole and forming an aligning face for the edge profiles.

The invention provides an eccentric clamp in which the eccentricity of a single eccentric disc is utilized to swivel two separately swivel-mounted clamping jaws simultaneously and uniformly by a single rotary motion of the eccentric, without elaborate bolted connections. It is of advantage that the reactive force encountered at the bearing of the eccentric during the swivel motion into the clamping position can be utilized for aligning the formwork panels.

BRIEF DESCRIPTION OF THE DRAWINGS

The invention is described below in greater detail with reference to an exemplary embodiment, and the accompanying drawings in which:

A clamp designated generally as 1 serves to connect formwork panels which are arranged side by side in a plane and have edge profiles 2, here hollow profiles, running round them. FIGS. 1 and 2 show only these hollow profiles 2 without the forming surfaces to be applied to them.

Figure 1:
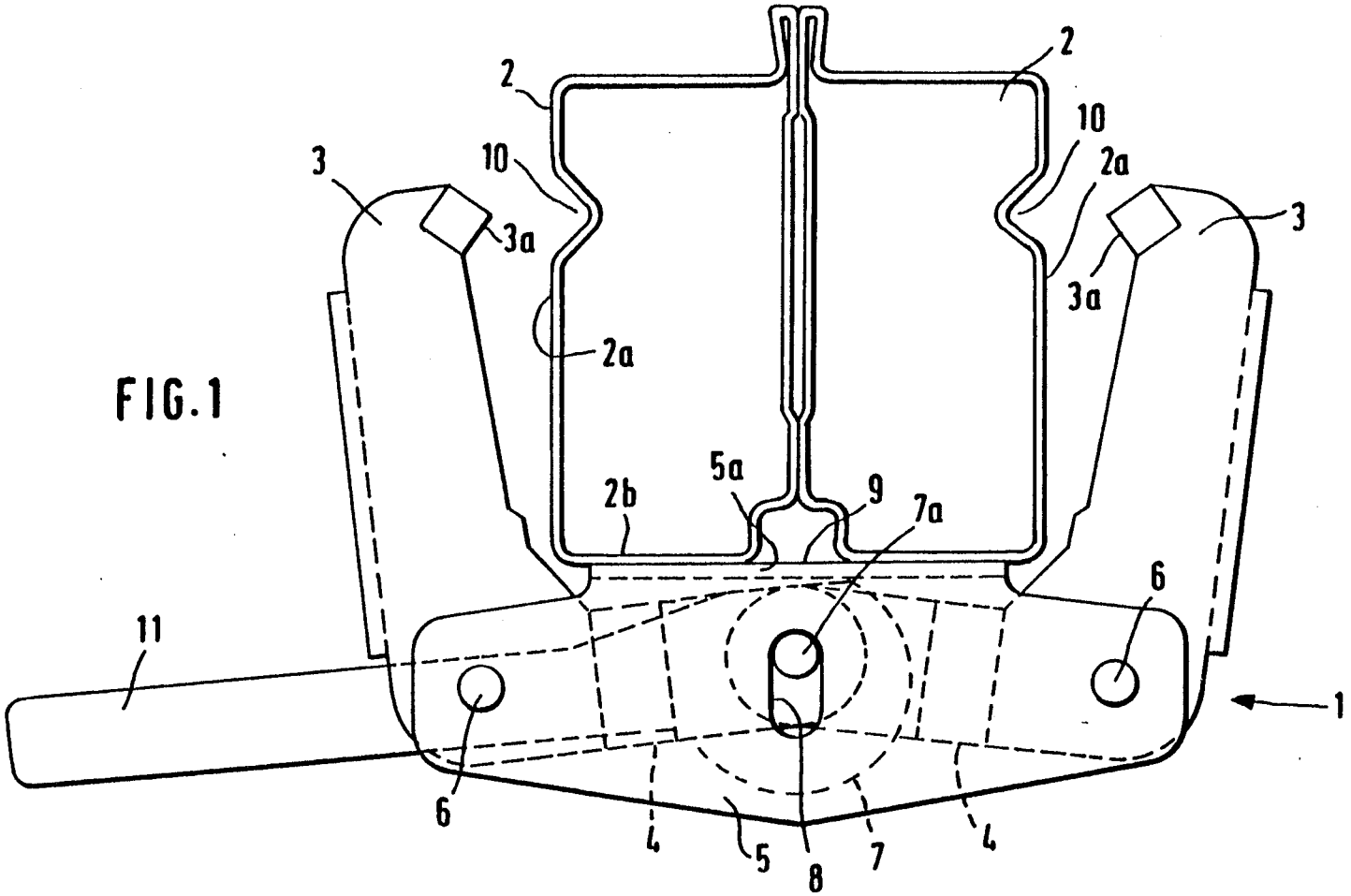
FIG. 1 is a top view of a clamp according to the invention, the clamp being in the open position but prepared for to brace two abutting, hollow, edge profiles of two coplanar formwork panels.
Figure 2:
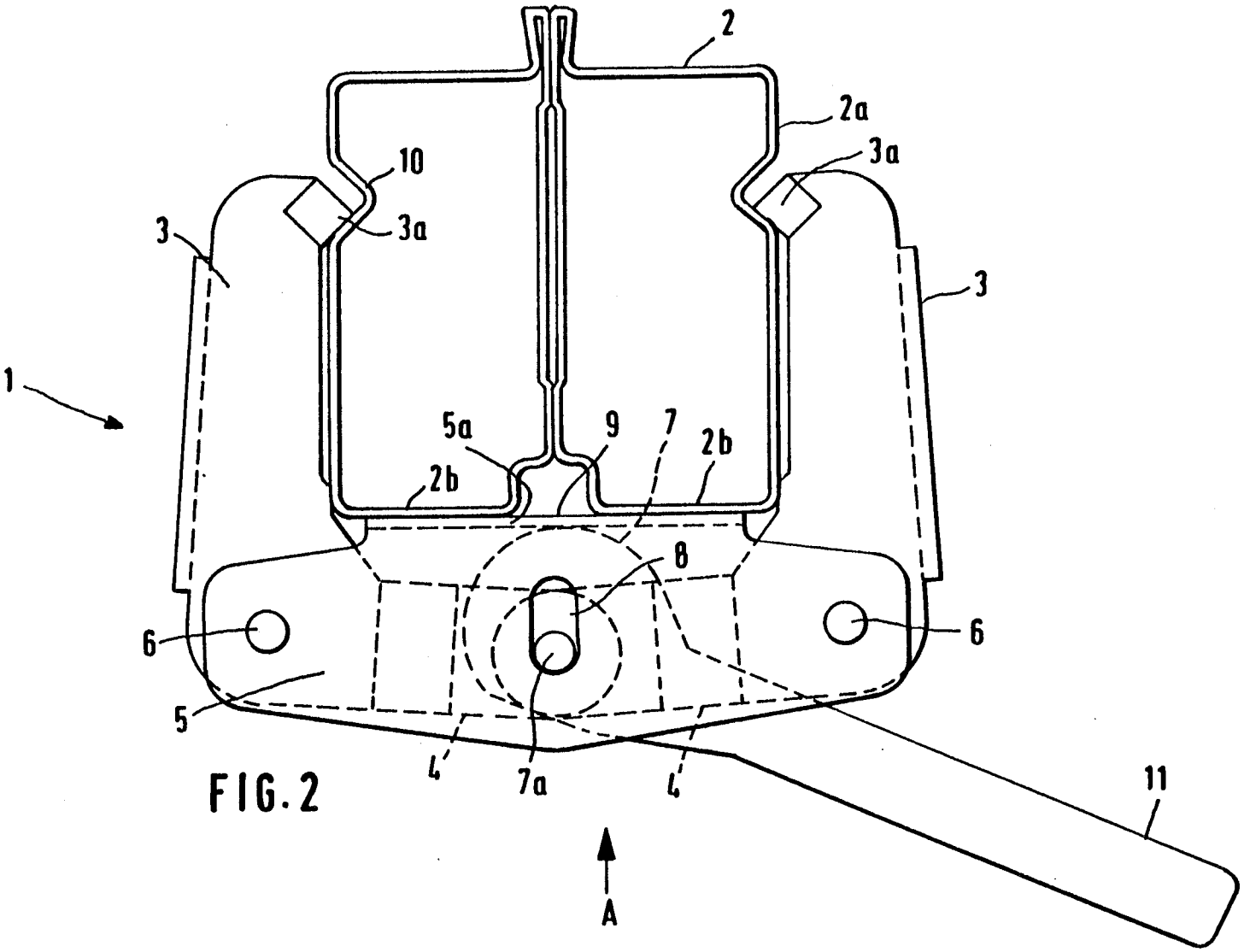
FIG. 2 is a view corresponding to FIG. 1, after the clamp has been closed and braced.

The clamp 1 has two gripping jaws 3 which are adapted to be swivelled against and urge together the oppositely directed longitudinal faces 2*a* of the abutting edge profiles 2, and an actuating member yet to be described for swivelling of the gripping jaws 3. At the end of a gripping jaw 3 remote from the clamping point 3*a* is an adjusting arm 4 oriented at an angle to the respective gripping jaw 3 adjusting arms 4 of the two gripping jaws 3 are directed towards each other. Both gripping jaws 3 are swivel-mounted on a common bracket 5 approximately in the corner area of the transition to their arms 4. The swivel joints 6 can be particularly clearly seen in FIGS. 1 and 2.

Figure 3:
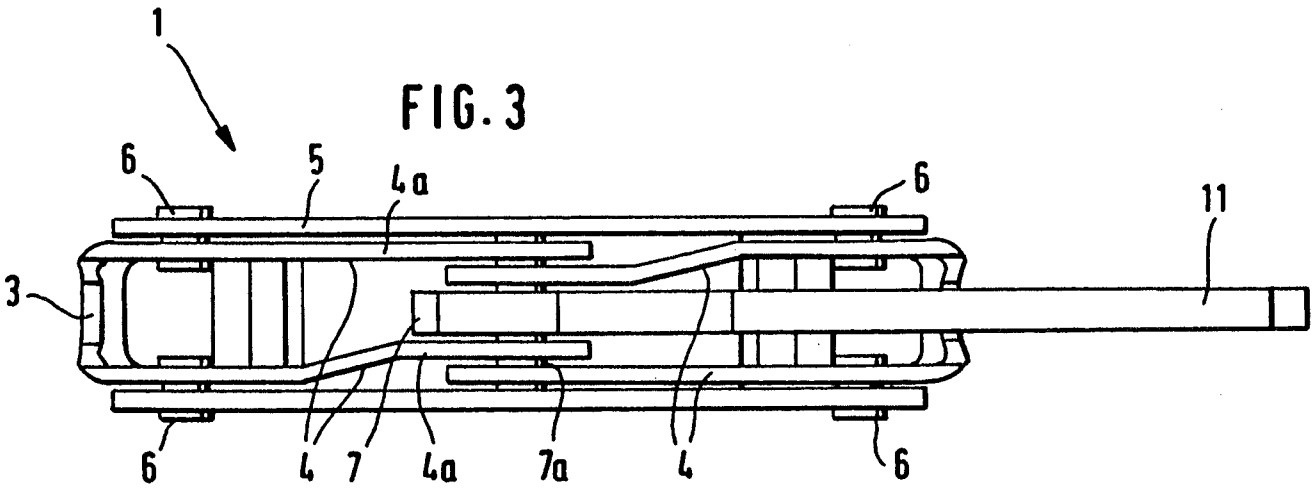
FIG. 3 is a rear view of the clamp seen in the direction of arrow A in FIG. 2.

It becomes clear by reference to FIG. 3 that the ends of the two adjusting arms 4 overlap, these arms 4 being formed by superposed flat elements 4a capable of interengaging one another. In the region where the two adjusting arms 4 overlap, both are engaged by a pivot pin 7a of eccentric 7. The pivot pin 7a is slidable in an oblong hole 8 which is formed in the bracket 5 and is disposed perpendicular to the forming surface (not shown). As it rotates, the eccentric disc 7 proper is supported against the bracket 5 and against a cross bar 5a yet to be described.

The gripping jaws 3 and their adjusting arms 4 are case approximately perpendicular to each other and the adjusting arms 4 are oriented approximately in the direction in which the bracket 5 extends. The bracket 5 serving to accommodate the adjusting or swivel arms 4, the joints 6 and the eccentric 7 has a stop face 9 turned towards the profiles 2 to be braced, the stop face running parallel to the forming surface and to the webs 2b of the hollow profiles 2 facing away from the forming surface. In the illustrated embodiment, the stop face 9 is disposed on the outside of the cross bar 5a.

In order to form the clamping points 3a, the gripping jaws 3 have projections fitting into corresponding depressions 10 of the hollow profiles 2. The projections and the depressions 10 have angular surfaces know per se for drawing the stop face 9 of the cross member 5 and its cross bar 5a against the hollow profiles 2. Bracing of the clamp 1 therefore also brings about in an advantageous way an exact alignment of the edge webs or edge brackets 2 of the formwork panels to be connected.

According to FIG. 3, the cross member 5 accommodating the swivel bearings 6 of the gripping jaws 3 has a U-shaped cross section, the cross bar 5a of the U facing the edge profiles 2 to be connected and forming the stopping and aligning face 9.

It is evident in all three Figures that the accentric 7 is connected—in the illustrated embodiment integrally so—to an actuating lever 11. It is therefore possible for the entire clamp to be very simply operated by swinging this actuating lever 11 from the position evident in FIG. 1 into that shown in FIG. 2.

When the gripping jaws 3 are open (FIG. 1), this actuating lever 11 disposed on the eccentric disc 7 is situated approximately parallel to the forming surface and approximately at right angles to the gripping jaws 3. The area of greatest eccentricity of the eccentric disc 7 is arranged on a line running approximately at right angles to the actuating lever 11 and also roughly in the direction in which the oblong hole 8 is oriented.

The length of the oblong hole 3 for the bearing pin 7a of the eccentric 7 corresponds at least to the greatest eccentricity of the eccentric 7, in order that the forced shift of the bearing pin 7a as the eccentric disc 7 rotates and thereby the swivel motion of the adjusting arms and clamping jaws 3, can take place in an unhindered way. The eccentricity of the eccentric disc 7 and the length of the oblong hole 8 for the swivel pin 7a of the eccentric 7 are dimensioned such that, in the closed position (FIG. 2), the two adjusting arms 4 of the gripping jaws 3 together form an obtuse angle with that side of the arms which faces the forming surface while, in the open position, such an obtuse angle is formed on the opposite side. Therefore, during bracing, a dead centre is passed and self-locking in the closed position is achieved.

The clamp produces a highly accurate, symmetrical application of force which not only urges together but also aligns the two edge profiles 2. Nevertheless, the entire operation of the clamp can be carried out very simply and quickly, both when fixing and releasing the clamp.

The configuration and arrangement of the clamp 1, the joints 6 thereof and the eccentric having its bearing pin 7a slidably disposed midway between and parallel to the two joints 6 have a further advantage. This advantage consists in that the path of movement of the eccentric lever lies along a circular segment which faces away from the formwork and the edge webs 2 and in a plane running perpendicular to the formwork. Therefore, this movement of the eccentric lever 11 takes place very conveniently and without hindrance by the formwork, both when closing and when opening the clamp 1. Mention is made that the swivel pin 7a of the eccentric 7 does not necessarily have to be guided in an oblong hole 8, but is already guided exactly enough transversely to the direction of the forming surface through the attachment to the two adjusting arms 4 in their overlapping area. It is of importance only that the eccentric 7 with its swivel pin 7a or similar shaft engages both adjusting arms 4 in the region of overlap and that the outer periphery of the eccentric rests against that side of the cross bar 5a of the bracket 5 which face away from the hollow profiles 2. The increasing distance of the outer periphery of the eccentric 7 from its swivel pin 7a results in movement of the swivel pin 7a relative to the cross bar 5a, and thereby a swivel motion of the adjusting arms 4, as the eccentric 7 is rotated.

I claim

1. A clamp for connecting formwork panels, particularly formwork panels which are to be disposed side-by-side in a common plane and have profiles extending peripherally thereof, comprising a pair of clamping members each of which includes a clamping arm for urging one formwork panel towards another and an adjusting arm which is noncollinear with the respective clamping arm, said adjusting arms having overlapping end portions; means mounting said clamping members for pivotal movement between a rest position and an operative position in which said clamping arms can urge respective formwork panels towards each other, said mounting means comprising a hollow support and pivot pins connecting said clamping members to said support; and means for pivoting said clamping members between said positions, said pivoting means including an eccentric cam which engages both of said end portions, and said cam comprising a pivot which is movable transverse to said adjusting arms, said adjusting arms and said cam being received in said support.

2. The clamp of claim 1, wherein each of said adjusting arms comprises a plurality of spaced, substantially flat elements and the elements of one adjusting arm alternate with the elements of the other adjusting arm at said end portions in the axial direction of said pivot.

3. The clamp of claim 1, wherein each of said clamping arms is at least approximately perpendicular to the respective adjusting arm.

4. The clamp of claim 1, wherein said clamping arms arms project from said adjusting arms in a predetemined direction and said support has an abutment surface for formwork panels, said abutment surface facing in said predetermined direction.

5. The clamp of claim 4, wherein said abutment surface is substantially perpendicular to said predetermined direction.

6. The clamp of claim 4, wherein said support comprises a bearing portion which receives said pivot pins and another portion extending transversely of said bearing portion, said abutment surface being provided on said other portion.

7. The clamp of claim 1, wherein each of said clamping arms has a projection receivable in a recess of a respective formwork panel to thereby establish a connection between the clamping arm and the panel.

8. The clamp of claim 7, wherein each of said projections has a surface which is inclined to the respective clamping arm and can cooperate with a corresponding surface on a formwork panel to urge the clamping arm and the panel towards one another.

9. The clamp of claim 1, wherein said pivoting means comprises an actuating lever which is connected to said cam.

10. The clamp of claim 9, wherein said lever is integral with said cam.

11. A clamp for connecting formwork panels, particularly panels which are to be disposed side-by-side and have profiles extending peripherally thereof, comprising a pair of clamping members each of which includes a clamping arm for urging one formwork panel towards another and an adjusting arm which is noncollinear with the respective clamping arm, said adjusting arms having overlapping end portions; means mounting said clamping members for pivotal movement between a rest position and an operative position in which said clamping arms can urge respective formwork panels towards each other, said mounting means comprising a support and pivot pins connecting said clamping members to said support, said adjusting arms and said support extending at least approximately along the same direction; and means for pivoting said clamping members between said positions, said pivoting means including an eccentric cam which engages both of said end portions, and said cam comprising a pivot which is movable transverse to said adjusting arms.

12. A clamp for connecting formwork panels, particularly formwork panels which are to be disposed side-by-side in a common plane and have profiles extending peripherally thereof, comprising a pair of clamping members each of which includes a clamping arm for urging one formwork panel towards another and an adjusting arm which is noncollinear with the respective clamping arm, said adjusting arms having overlapping end portions; means mounting said clamping members for pivotal movement between a rest position and an operative position in which said clamping arms can urge respective formwork panels towards each other, said mounting means comprising a U-shaped support and pivot pins connecting said clamping members to said support; and means for pivoting said clamping members between said positions, said pivoting means including an eccentric cam which engages both of said end portions, and said cam comprising a pivot which is movable transverse to said adjusting arms.

13. The clamp of claim 12, wherein said support has a pair of legs and a web bridging said legs, said web being provided with an abutment surface for formwork panels.

14. A clamp for connecting formwork panels, particularly formwork panels which are to be disposed side-by-side in a common plane and have profiles extending peripherally thereof, comprising a pair of clamping members each of which includes a clamping arm for urging one formwork panel towards another and an adjusting arm which is noncollinear with the respective clamping arm, said adjusting arms having overlapping end portions; means mounting said clamping members for pivotal movement between a rest position and an operative position in which said clamping arms can urge respective formwork panels towards each other; and means for pivoting said clamping members between said positions, said pivoting means including an eccentric cam which engages both of said end portions and comprises a pivot which is movable transverse to said adjusting arms, said pivoting means further including an actuating lever which is connected to said cam, said lever extending along a direction between said clamping arms and being approximately perpendicular to the latter when said clamping members are in said rest position.

15. The clamp of claim 14, wherein said mounting means comprises a support and pivot pins connecting said clamping members to said support.

16. The clamp of claim 15, wherein each of said clamping arms defines an intersection with the respective adjusting arm and said pivot pins extend through the respective intersections.

17. The clamp of claim 14, wherein said cam has a portion disposed at a maximum distance from said pivot and said portion of said cam is approximately perpendicular to said lever.

18. A clamp for connecting formwork panels, particularly formwork panels which are to be disposed side-by-side in a common plane and have profiles extending peripherally thereof, comprising a pair of clamping members each of which includes a clamping arm for urging one formwork panel towards another and an adjusting arm which is noncollinear with the respective clamping arm, said adjusting arms having overlapping end portions; means mounting said clamping members for pivotal movement between a rest position and an operative position in which said clamping arms can urge respective formwork panels toward each other, said mounting means comprising a support and pivot pins connecting said clamping members to said support, said support being provided with an opening which is elongated transverse to said adjusting arms; and means for pivoting said clamping members between said positions, said pivoting means including an eccentric cam which engages both of said end portions, and said cam comprising a pivot which is movable transverse to said adjusting arms and is guided in said opening.

19. The clamp of claim 18, wherein said cam has a portion disposed at a maximum distance from said pivot and said opening has a length at least equal to said maximum distance.

20. The clamp of claim 18, wherein each of said adjusting arms has a side which faces said clamping arms, the eccentricity of said eccentric member and the length of said opening being such that said sides define an obtuse angle when said clamping members are in said operative position.

21. A clamp for connecting formwork panels, particularly formwork panels which are disposed side-by-side in a common plane and have profiles extending peripherally thereof, comprising a pair of clamping members each of which includes a clamping arm for urging one formwork panel towards another and an adjusting arm which is noncollinear with the respective clamping arm, said adjusting arms having overlapping end portions; means mounting said clamping members for pivotal movement between a rest position and an operative position in which said clamping arms can urge respective formwork panels towards each other, said mounting means comprising a support and pivot pins connecting said clamping members to said support, said support including a bearing portion which receives said pivot pins and another portion extending transversely of said bearing portion, said other portion having a side which faces away from said clamping arms; and means for pivoting said clamping members between said positions, said pivoting means including an eccentric cam which engages both of said end portions, said cam comprising a pivot which is movable transverse to said adjusting arms and said cam travelling along a predetermined path during movement of said clamping members between said rest position and said operative position, said cam engaging said side of said other portion of said support in at least a portion of said path.

22. The clamp of claim 21, wherein said end portions are engaged by said pivot.

* * * * *